United States Patent [19]

Weichman et al.

[11] 4,133,741

[45] Jan. 9, 1979

[54] METHOD FOR RECOVERY OF HYDROCARBON FRACTIONS FROM HYDROCARBON-BEARING MATERIALS

[75] Inventors: Bernard E. Weichman, Houston, Tex.; John H. Knight, Aurora, Colo.

[73] Assignee: The Superior Oil Company, Houston, Tex.

[21] Appl. No.: 520,981

[22] Filed: Nov. 5, 1974

[51] Int. Cl.[2] ..... C10B 53/06

[52] U.S. Cl. ..... 208/11 R

[58] Field of Search ..... 208/8, 11; 202/117

[56] References Cited

U.S. PATENT DOCUMENTS

| | | | |
|---|---|---|---|
| 1,814,463 | 7/1931 | Trent | 202/117 |
| 3,325,395 | 6/1967 | Ban | 208/11 R |
| 3,464,892 | 9/1969 | Bennett | 208/11 R |
| 3,475,279 | 10/1969 | Bowman | 208/11 R |
| 3,483,115 | 12/1969 | Haddad et al. | 208/11 R |
| 3,560,369 | 2/1971 | Rowland et al. | 208/11 R |
| 3,623,972 | 11/1971 | Bennett | 208/11 R |
| 3,644,193 | 2/1972 | Weggel et al. | 208/11 R |
| 3,761,359 | 9/1973 | Von Hippel | 208/11 R |

*Primary Examiner*—Delbert E. Gantz
*Assistant Examiner*—Joan Thierstein
*Attorney, Agent, or Firm*—Arnold, White & Durkee

[57] ABSTRACT

A plurality of hydrocarbon fractions are recovered from hydrocarbon-bearing material such as oil shale in a continuous retort wherein a bed of the material is moved through a heating chamber, the heating being for a time and at a temperature effective to strip increasingly heavier hydrocarbon fractions from the material as it moves through the heating chamber. The hydrocarbon fractions are collected by a plurality of collection means disposed along the path of movement of the bed for recovery of a corresponding plurality of hydrocarbon fractions.

1 Claim, 3 Drawing Figures

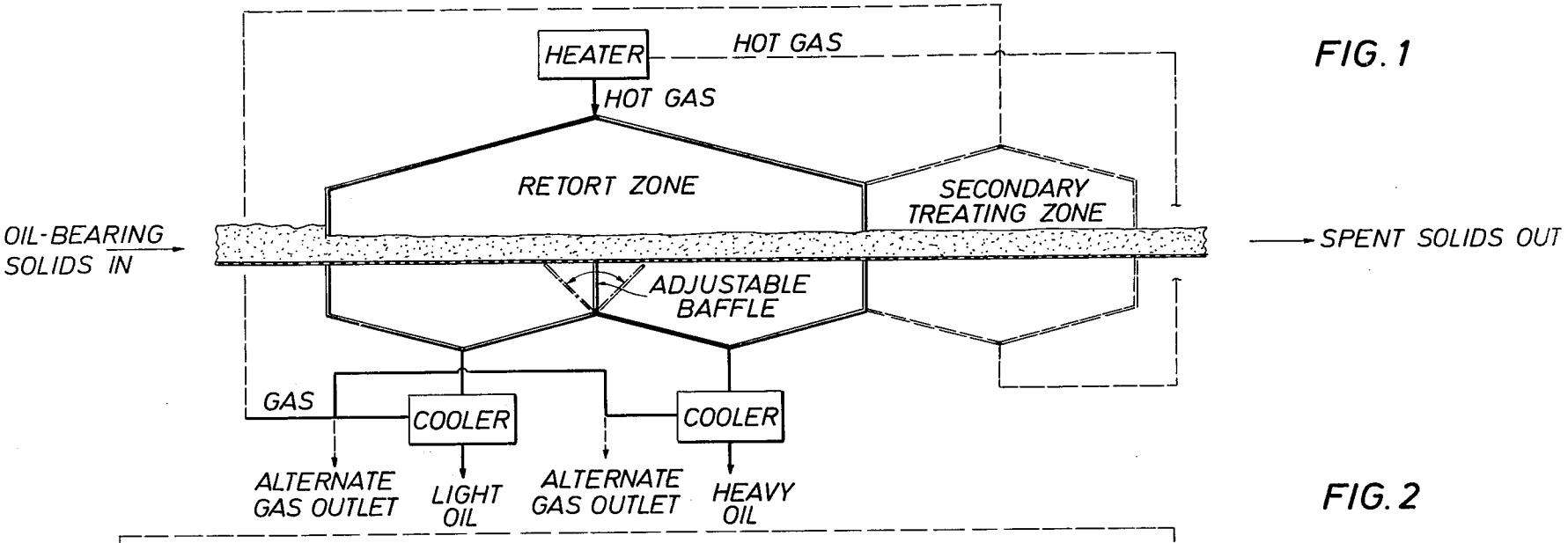
FIG. 1
SPENT SOLIDS OUT
SECONDARY TREATING ZONE
HOT GAS
HOT GAS
HEATER
RETORT ZONE
ADJUSTABLE BAFFLE
COOLER
COOLER
HEAVY OIL
ALTERNATE GAS OUTLET
LIGHT OIL
ALTERNATE GAS OUTLET
GAS
OIL-BEARING SOLIDS IN

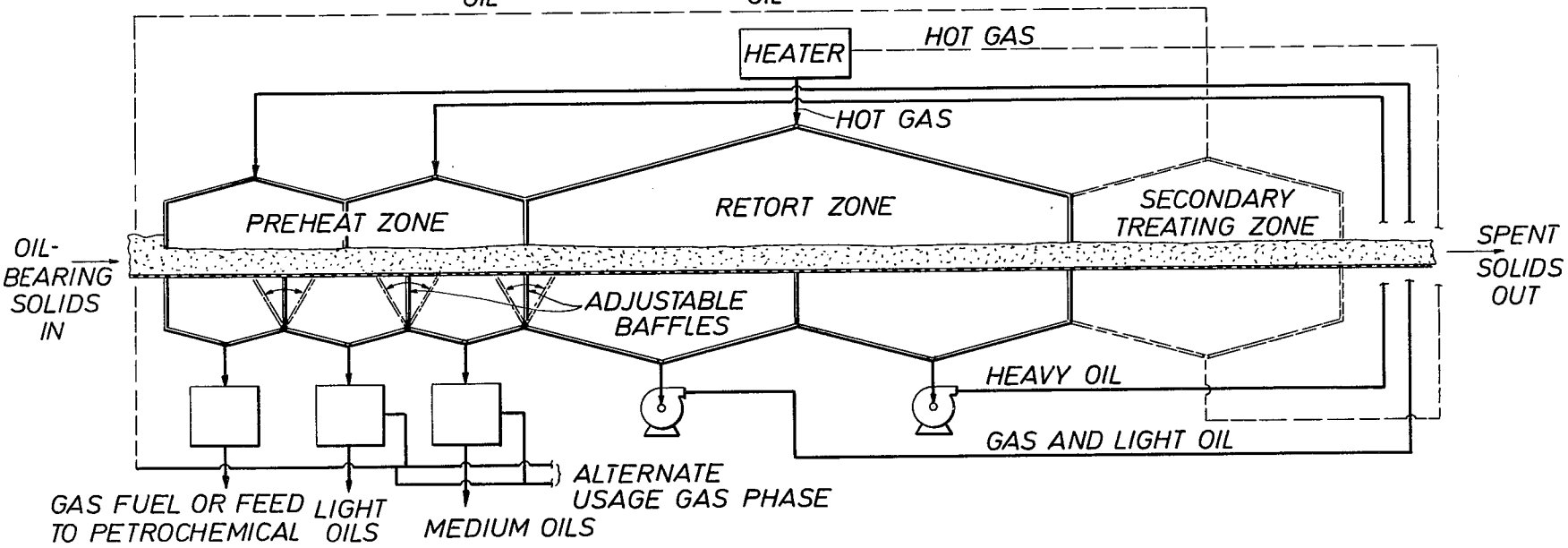
FIG. 2
SPENT SOLIDS OUT
SECONDARY TREATING ZONE
HOT GAS
HOT GAS
HEATER
RETORT ZONE
HEAVY OIL
GAS AND LIGHT OIL
ADJUSTABLE BAFFLES
ALTERNATE USAGE GAS PHASE
MEDIUM OILS
PREHEAT ZONE
LIGHT OILS
GAS FUEL OR FEED TO PETROCHEMICAL
OIL-BEARING SOLIDS IN

METHOD FOR RECOVERY OF HYDROCARBON FRACTIONS FROM HYDROCARBON-BEARING MATERIALS

BACKGROUND OF THE INVENTION

The present invention relates to methods for recovering hydrocarbons, and, more particularly, to a method for recovering hydrocarbon fractions from oil-bearing materials such as oil shale in a continuous traveling grate retort.

Large deposits of oil-bearing shale exist which have been almost entirely untouched because of the lack of an economical process for recovery of the oil. The many processes for recovery which have been proposed, either for in situ recovery or for the retorting of mined oil shale, have not satisfied the requirements of producing the oil in defined hydrocarbon fractions or at a cost comparable to conventional sources.

The oil present in oil shale is in a form called "kerogen" which is an organic waxy compound. When heated over a period of time and to an appropriate temperature, pyrolysis of the oil shale occurs to yield gaseous and liquid hydrocarbon fractions. As the temperature of the oil shale increases, the liquid products of such retorting get progressively heavier. In most retorts, a bed of oil shale is heated and the oil is evolved, condensed, and collected. Conversion of the kerogen to shale oil and its evolution or eduction from the oil shale starts at the point of introduction of heat to the bed. AS the temperature front so generated moves through the bed, the retorting process correspondingly progresses through the bed.

In a fixed bed or batch type retort, such as a vertical furnace or kiln, the initially educed products (gas and light oils) must pass through the entire bed of cooler shale before recovery is accomplished. As a consequence, condensation and revaporization occur as the temperature front moves through the various levels of the bed. Subsequently evolved products have a correspondingly shorter path through the remainder of the cooler bed. Thus the cooler shale acts as a fractionator, mist agglomerator, and mist separator or collector. This results in the concentrating of gas and light oil in the initial off-gas product, with further evolution and revaporization of the oil as the temperature of the bed increases. A gradient of light to heavy oils is produced from start to finish of the retorting process, with the heavy hydrocarbon fractions appearing at or near completion of the retorting. However, batch type retorts have not proven economically advantageous due to the limited throughputs which may be achieved in such apparatus.

Oil shale retorts, therefore, are preferably adapted for continuous operation in which a bed of crushed solid material is continuously passed through the retort to be heated and the hydrocarbon products evolved. The hydrocarbon products of the prior art continuous retorting operations, such as rotary kilns and straight line or circular traveling grate retorts, have required further treatment to obtain marketable or usable hydrocarbon fractions.

SUMMARY OF THE INVENTION

In cross flow retorts, such as straight or circular traveling grate retorts, mined and crushed oil shale particles are formed into a generally fixed vertical bed which then is moved horizontally on a moving grate through a heating zone or chamber. In the chamber, hot gas is passed vertically down through the moving bed to progressively raise the temperature of the oil shale particles as they move through the heating chamber. As the shale particles at the top of the bed are heated, more of the sensible heat of the hot gas is available to heat the lower particles. This produces a temperature front or profile in the bed as it moves through the chamber. The hot gas strips progressively heavier hydrocarbon fractions from the moving bed of oil shale as the particles are exposed to increasingly higher temperatures for increasingly longer times. The retort off-gases downstream of the bed then are collected in separate fractions along the path of the bed by partitioning off gas plenums or splitters along the bottom of the traveling grate and collecting the respective hydrocarbon fractions as they are evolved from the moving bed. Both noncondensable and condensable gaseous hydrocarbon products are recovered together with entrained liquid hydrocarbons.

BRIEF DESCRIPTION OF THE DRAWINGS

Specific embodiments of the present invention will now be described with reference to the accompanying drawings in which:

FIG. 1 is a schematic illustration in section elevation of a traveling grate oil shale retort which may be used in one embodiment of the method of the present invention;

FIG. 2 is a schematic illustration similar to FIG. 1, further including a preheat zone prior to the retort zone.

DETAILED DESCRIPTION OF SPECIFIC EMBODIMENTS

Figure 3:
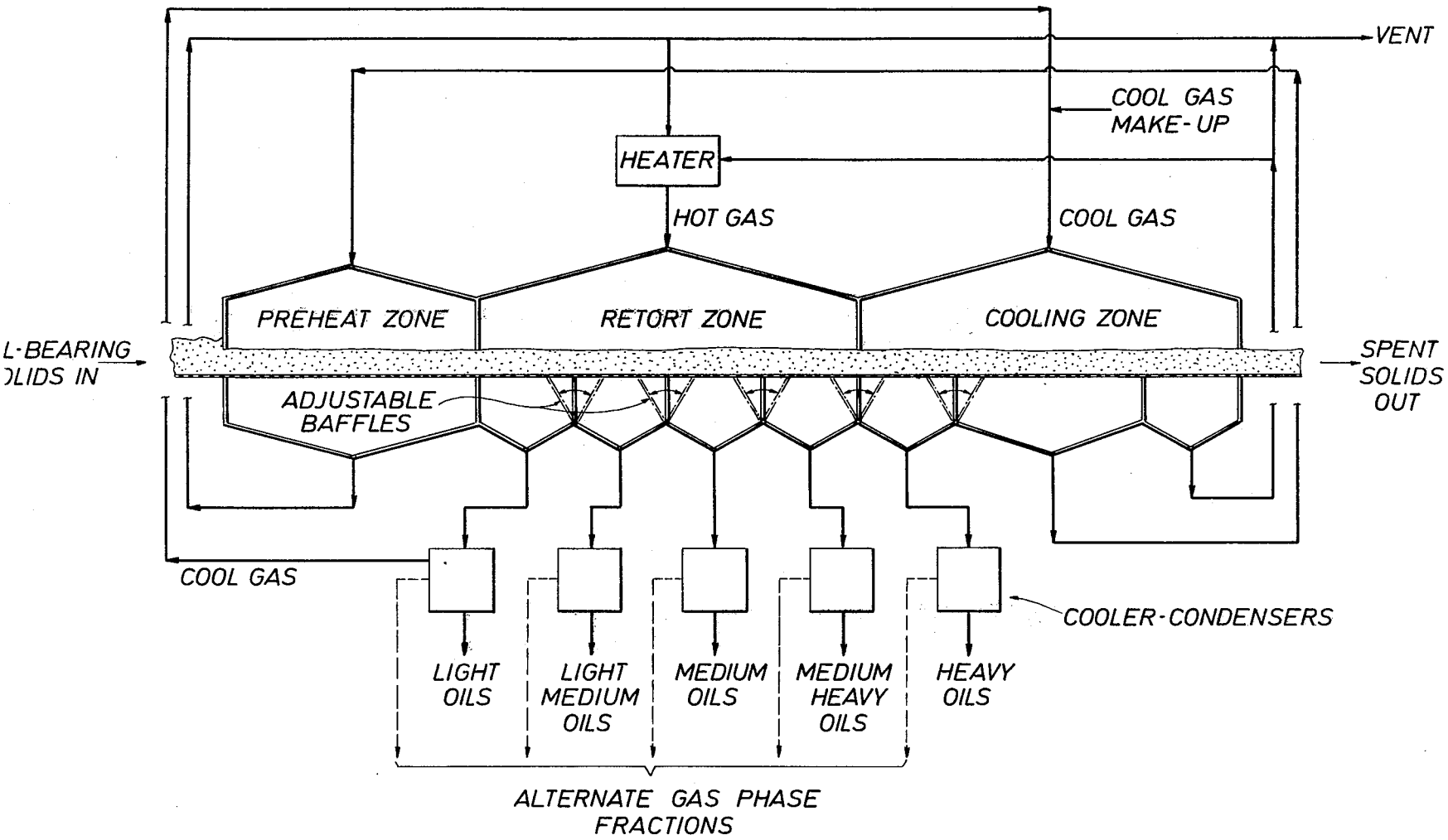
FIG. 3 is a schematic illustration similar to FIGS. 1 and 2, further including a cooling zone following the retort zone.

Referring now to FIG. 1 of the drawings, one embodiment of a method according to the present invention will be described with reference to a schematic illustration of apparatus suitable for use in accomplishing the various steps of the method. Suitable apparatus for carrying out the method of the present invention is commercially available, and need not be described in detail. For example, straight and circular traveling grates, such as those manufactured by Arthur G. McKee & Co. or McDowell-Wellman Engineering Co., both of Cleveland, Ohio, are generally well suited to the practice of the present invention. More specifically, apparatus such as that described in U.S. Pat. No. 3,302,936, which is incorporated herein by reference, may be used as hereinafter discussed. Hoods and windboxes are disposed respectively above and below the traveling grate and preferably are sealed to prevent entry of atmospheric air or loss of hydrocarbon components.

It will be appreciated that while the invention will be discussed with reference to the retorting of oil shale, it may be practiced to recover hydrocarbon fractions from other hydrocarbon-bearing materials, such as coal, tar sands, and the like. Furthermore, the embodiments described herein are to be regarded as merely illustrative and not limiting of the scope of the present invention.

In accordance with one embodiment of the present invention, mined oil shale is first crushed to particle sizes ranging between about ¼ inch and 3 inches in greatest dimension, although larger particle sizes of 6 to 12 inches or more may be utilized by varying the heating times accordingly. The crushed oil shale particles are loaded upon a traveling grate to form a vertical bed. The load may advantageously be segregated in layers to place the larger particles near the top of the bed, where they will be subjected to the longest periods of high temperature heat, and the smaller particles adjacent the grate surface. The spacing of the grate bars is such as to prevent sifting of the smaller particles through the grate. The depth of the bed may vary anywhere from a few inches to 8 feet or more, and typically is about 4 or 5 feet. The typical width of the grate is about 2 to 20 feet. Uniformity of heating is more readily maintained when the bed is relatively uniform in depth and the particle size does not vary radically from top to bottom.

The bed of oil shale particles is moved into and through a retort zone wherein heating is accomplished by a cross flow of hot gas. The hot gas flow is preferably vertically downward through the bed, normal to the path of movement of the bed, as upward flow tends to lift particles or otherwise disturb the bed except at relatively low gas flow rates and pressure drops. The gas preferably is a neutral or reducing gas to prevent combustion of the hydrocarbons being recovered, and is at a temperature of about 1000°–1500° F. for the retorting of oil shale. The oil shale particles are heated for a time and temperature sufficient to educe hydrocarbons therefrom, for example about 800°–1100° F. In the section of the retort zone near the point of solids entry, gas and oils are given off as hydrocarbon products. These oils must pass through a lower layer of cool shale, which condenses the heavier oils, and these oils collect on the cooler shale particles in the lower portion of the bed. Gas and light oils selectively pass through the bed and are collected by a first collection duct or plenum and passed to a first cooler-separator system, which acts as a fractionator and separates the light oil from the gas for recovery.

As the bed of oil shale particles continues to move through the retort zone, the particles are progressively subjected to higher and higher temperatures. A temperature front is established in the bed and moves downwardly in the bed as the bed moves through the heating chamber. As the temperature front moves downwardly through the bed, the previously condensed heavy oils are revaporized. Thus, at the higher temperatures, a heavier oil (hydrocarbon) fraction is extracted from the oil shale. The oil and gas educed in the later regions of the retort zone, i.e., further downstream from the bed entry point, are collected by a second collection duct or plenum and passed to a second cooler-separator system for recovery of the heavier oil fraction. It will be appreciated, of course, that the cooler-separator system referred to herein is of conventional design and may include equipment such as, for example, condensers, cyclone separators, scrubbers, electrostatic precipitators, and the like. The two off-gas collection systems also may be utilized to separate the corresponding gas phases to provide gases having different heating values and chemical compositions. It will be appreciated that this affords selective feed stock gas which may be used as a fuel or provided to secondary petro-chemical processing facilities for further recovery. Alternatively, the two oil-depleted off-gas fractions from the retort zone may conveniently be combined and returned for reuse in the retorting process. The spent shale solids may be cooled and removed from the traveling grate for further processing or disposal as appropriate.

Although FIG. 1 shows only two off-gas collection chambers or plenums, it will be appreciated that a greater number of hydrocarbon fractions may be obtained by correspondingly increasing the number of collection chambers and associated cooler-separator systems. The content of the various hydrocarbon fractions recovered according to the present invention may be varied not only by the number and location of the collection chambers along the path of the traveling grate, but by the provision of adjustable baffles or splitters between adjacent chambers as shown in phantom in the drawings. Such adjustable baffles or splitters conveniently may be made of flat steel plate or the like mounted about a horizontal axis normal to the direction of travel of the grate. By maintaining the width of the plate the same as the distance between collector side walls, no off-gas is lost. The plates may be mounted to the respective chamber end walls by hinges and held in respective locations by placement pins or pegs located in the side walls of the chambers to limit travel thereof. In this manner the objects of the present invention may more readily be obtained.

A variation of the present invention is illustrated in FIG. 2, which shows a cross flow retort further including an oil shale preheat zone. Preheating improves the thermal efficiency of the process by utilizing the recycled off-gas to preheat the cool input shale prior to retorting. Crushed oil shale is placed on a traveling grate as in the embodiment of FIG. 1. As the bed passes into the preheat zone, oil-bearing hot off-gas from the retort zone is passed through the bed and hydrocarbon fractions are condensed onto the cooler shale. Near the solids entry section of the preheat zone, where the oil shale particles are relatively cool, only a gaseous hydrocarbon fraction is recovered. As the solids continue through the preheat zone, the increasing temperature results in the eduction and revaporization of liquid hydrocarbon fractions. In the second gas plenum of the preheat zone, light oil is recovered. The off-gas containing the light oil is collected and passed on to product recovery. Near the solids exit from the preheat zone, the temperature is sufficiently high to begin educing medium oil. The off-gas containing the medium oil fraction similarly is collected and passed to product recovery.

The solids progress from the preheat zone into the retort zone. In the retort zone, the solids are subjected to a downward flow of hot gas to further elevate the temperature. In the retort zone, gas, light oil, and heavy oil are extracted from the oil shale, and the off-gases are recycled for use in the preheat zone as discussed above.

Recycling of the retort zone off-gases to the preheat zone establishes a hydrocarbon condensation and revaporization cycle subjecting them to thermal cycling. The heavier products condense and collect on the incoming cooler oil shale particles and are carried back into the retort zone where they again will be exposed to high temperatures and revaporized to accomplish selective thermal cracking of the heavy oils into more desirable hydrocarbon fractions.

As discussed above, the number of collection chambers may be altered to increase or decrease the number of hydrocarbon fractions recovered. Similarly, the relative sizes of the chambers and their respective locations may be modified to vary the content of the corresponding hydrocarbon fractions.

Yet another variation of the method of the present invention is illustrated in FIG. 3, which shows a cross flow retort having both a preheat zone and a cooling zone. As before, the oil shale particles are formed into a bed on a traveling grate. The solids first enter the preheat zone, which in the illustrated embodiment receives heated off-gas from the cooling zone. The sensible heating value of the cooling zone off-gas is utilized to preheat the incoming bed of solids.

The preheating of the solids bed continues as the grate moves the bed toward and into the retort zone. In the retort zone, hot gas from an external heater is forced downwardly through the bed to accomplish the heating necessary to retorting of the oil shale. As in the foregoing examples, the oil shale particles are heated to progressively higher temperatures as they move through the retort zone and increasingly heavier hydrocarbon fractions are stripped therefrom. The various hydrocarbon fractions educed from the solids as they move through the retort zone are collected at corresponding locations along the traveling grate path, and the off-gases are processed to separate and condense out the respective gas and liquid fractions. Off-gas from the coolers is separated from the hydrocarbon product and supplied ahead to the cooling zone, where it is reheated by passing over the spent shale. As an alternative, the various gas phase fractions may be kept separate for use as selective feeds to petrochemical operations or for process fuel.

The bed of oil shale particles moves from the retort zone into the cooling zone, where the cool off-gas separated from the retort zone products is used to cool the bed. The heated off-gas from the cooling zone then is introduced into the preheat zone to preheat the newly entering oil shale as described above. Heated gas from the final cooling portion of the cooling zone may be supplied either to the external heater for the retort zone or vented along with the off-gas from the preheat zone.

It will be apparent from the foregoing description that the present invention provides a novel method for recovery of hydrocarbon fractions from oil shale or other hydrocarbon-bearing solids in a continuous retort. Accordingly, those skilled in this art will appreciate that many modifications and changes can be made in the particular embodiments of the invention herein described without constituting a departure from the spirit and scope thereof.

What is claimed is:

1. A method for recovering a plurality of gas and liquid phase hydrocarbon fractions from oil shale in a continuous traveling grate retort, comprising the steps of:

forming a gas permeable bed of crushed oil shale particles on a traveling grate;

moving the oil shale bed along a horizontal path through a retort zone;

passing a flow of hot neutral or reducing gas downwardly through the bed in the retort zone to heat the oil shale particles to a temperature of from about 800° F. to about 1100° F. for a time effective to strip increasingly heavier hydrocarbons from the particles as the particles are moved through the retort zone;

collecting the gas and liquid hydrocarbons below the bed in the retort zone in a plurality of collection means disposed along the path of the bed and having adjustable baffles; and adjusting the collection means baffles to collect a desired plurality of gas and liquid phase hydrocarbon fractions from the oil shale.

* * * * *